United States Patent [19]

Yoneyama et al.

[11] 4,210,471

[45] Jul. 1, 1980

[54] PERMANENT MAGNET MATERIAL AND PROCESS FOR PRODUCING THE SAME

[75] Inventors: Tetsuhito Yoneyama, Ichikawa; Tetsuo Hori, Sugamachi; Teruhiko Ojima, Nagareyama, all of Japan

[73] Assignee: TDK Electronics, Co., Ltd., Tokyo, Japan

[21] Appl. No.: 766,686

[22] Filed: Feb. 8, 1977

[30] Foreign Application Priority Data

| | | | |
|---|---|---|---|
| Feb. 10, 1976 | [JP] | Japan | 51-13600 |
| Mar. 16, 1976 | [JP] | Japan | 51-28431 |
| Mar. 22, 1976 | [JP] | Japan | 51-31131 |

[51] Int. Cl.[2] ..... H01F 1/08

[52] U.S. Cl. ..... 148/102; 75/170; 148/31.57

[58] Field of Search ..... 148/101, 103, 108, 31.57, 148/121, 122, 102; 75/152, 170, 0.5 R

[56] References Cited

U.S. PATENT DOCUMENTS

| | | | |
|---|---|---|---|
| 3,546,030 | 12/1970 | Buschow et al. | 148/31.57 |
| 3,560,200 | 2/1971 | Nesbitt et al. | 148/101 |
| 3,695,945 | 10/1972 | Benz | 148/103 |
| 3,698,055 | 10/1972 | Holtz et al. | 75/170 |
| 3,701,695 | 10/1972 | Buschow et al. | 148/103 |
| 3,839,101 | 10/1974 | Doser | 148/101 |
| 3,926,832 | 12/1975 | Barosi | 75/0.5 R |
| 3,947,295 | 3/1976 | Tawara et al. | 148/31.57 |
| 3,970,484 | 7/1976 | Doser et al. | 148/103 |
| 3,982,971 | 9/1976 | Yamanaka et al. | 148/31.57 |
| 4,047,982 | 9/1977 | Sagawa et al. | 148/101 |
| 4,075,437 | 2/1978 | Chin et al. | 148/31.57 |
| 4,081,297 | 3/1978 | Nagel et al. | 148/31.57 |

OTHER PUBLICATIONS

Strnat, K. et al.; Magnetic Properties of Rare-Earth-Iron Intermetallic Compounds; IEEE Transactions on Mag., pp. 489–493, (9/66).

*Primary Examiner*—L. Dewayne Rutledge
*Assistant Examiner*—Michael L. Lewis
*Attorney, Agent, or Firm*—Norman P. Friederichs

[57] ABSTRACT

Disclosed is the addition of Nb, V, Ta or Zr to the ternary alloy of R (rare earth)-Co-Cu for permanent magnet materials, to thereby provide the permanent magnets with increased coercive force, residual magnetization and energy product. The additional elements enables employment of such Cu and Fe contents of the alloy as less than 10% and more than 6%, respectively. These percentages were avoided in the prior art to prevent the reduction of Br and Hc, respectively.

42 Claims, 9 Drawing Figures

PERMANENT MAGNET MATERIAL AND PROCESS FOR PRODUCING THE SAME

The present invention relates to a permanent magnet material and, more particularly, to an improvement of a permanent magnet material consisting essentially of intermetallic compounds of the general formula of $R_2Co_{17}$, wherein the R component is at least one rare earth metal and the Co component is cobalt, as well as to a suited process to produce the permanent magnet material according to the invention.

The prior art of the rare earth cobalt permanent magnets includes U.S. Pat. No. 3,421,889 and U.S. Pat. No. 3,560,200. The former U.S. Patent discloses a basic composition of the rare earth metal and cobalt. The latter U.S. Patent discloses incorporation of copper, in an amount greater than 1.7 atomic percent to less than 71.5 atomic percent, into the basic compositions of the rare earth metal and cobalt, thereby improving coercive force of the magnet (page 1, column 2, lines 9 through 21, of the official gazette of the patent specification). The thus obtained coercive force of the magnet varies within the range of between approximately 2 KOe and 30 KOe, depending on the ratio of Cu to Co (FIG. 2 attached to the above-mentioned patent specification). A typical energy product value of the magnet disclosed in U.S. Pat. No. 3,560,200 is in excess of 9 million G.Oe with regard to the preferred composition of the magnet.

The prior art further includes Japanese Patent Application Laid Open No. 49-104192, which teaches to adjust the Cu content in the RCo type permanent magnet to create the energy product of 17 MG.Oe.

It is also known from the Summary of the 74th Lecture of the Japan Institute of Metals, 1974, page 175, and Japanese Patent Application Laid Open No. 50-94498 that both the contents of Cu, which is added to the $R_2Co_{17}$ type permanent magnet, and Fe are adjusted from a view point of securing excellent magnetic properties of the RCo type magnet. According to the statements in the above-mentioned Summary, the coercive force of this alloy steeply decreases below 2 KOe with an amount of Cu decreasing from 10% by weight and, thus, the Cu content should be from 10 up to 12% by weight of the alloy. In addition, according to the Japanese Patent Application Laid Open No. 50-111599, the Cu, which is added to the ternary alloy system of Sm-Co-Fe, exerts, with the increase in the Cu content, contrary effects on the magnetic property of the alloy, such that the coercive force increases and the residual magnetization decreases with the increase in the Cu content. It was, therefore, impossible to attain a high, excellent energy product, by the aid of the addition of Cu, because the coercive force increases but the residual magnetization decreases with an increase in the Cu content. Still further, the partial replacement of Co with Fe, thereby obtaining the quaternary alloy system of Sm-Co-Cu-Fe, contributes to the enhancement of the residual magnetization Br, however, the inclusion of Fe in excess of 6% by weight leads to the reduction of the coercive force of the alloy. It was, therefore, impossible to obtain high, excellent magnetic properties with the aid of inclusion of Fe, because the residual magnetization increases but the coercive force decreases with an increase in the Fe content.

In summary, it was previously impossible to obtain high coercive force with the compositions of low Cu and high Fe having high residual magnetization, so that magnetic properties, especially energy product, were not enhanced.

It is an object of the present invention to provide an improved permanent magnet of rare earth cobalt type with addition of Cu or both Cu and Fe, in which the magnetic properties are superior to those of alloys containing Cu or both Cu and Fe.

It is a specific object of the present invention to increase the coercive force of an RCo permanent magnet with an addition of from 10 to 12% by weight of copper, wherein the R component is at least one rare earth metal, and the Co component is cobalt or both cobalt and iron, which replaces a part of the cobalt until the iron content amounts to 6% by weight at the maximum, the contents of the R and Co components being the balance, preferably, from 24 to 28% by weight and from 56 to 70.8% by weight, respectively.

It is an important object of the present invention to provide a permanent magnet material having high coercive force and, thus, high energy product with regard to the compositions of low Cu and high Fe, which previously provided the magnet with only high residual magnetization but not the high coercive force.

In all of the above-mentioned objects, the intended energy product should be achieved in the enlarged composition ranges of Cu and Fe.

It is also an object of the present invention to provide a process for providing alloy compositions according to the present invention with the optimum magnetic properties.

It has now been found by the Inventors that an additional metallic element illustrated hereinbelow brings about the basic improvement of the ternary R-Co-Cu system, permanent magnet.

The additional metallic element, according to the present invention, is niobium, vanadium or tantalum in an amount from 0.2 to 4%, or zirconium in amount from 0.2 to 5%, preferably 0.5 to 2.5%, by weight of the alloy. The added Nb, V, Ta or Zr prevents both the reduction of the coercive force of the rare earth cobalt permanent magnet, due to the inclusion of Cu at less than 10% by weight thereinto, and the reduction of coercive force due to the inclusion of Fe at more than 6% by weight. According to this additional element, the lower limit content of the Cu can be reduced to 5% by weight, without inducing adverse effects on the magnetic properties of the permanent magnet. The cobalt can be replaced with iron in an amount higher than previously possible and can, therefore, be replaced with up to 15% by weight of Fe based on the weight of the permanent magnet.

Without the addition of the element, according to the present invention, the coercive force steeply decreases with an increase in the Fe content. However, according to the present invention, the coercive force is maintained at almost same value over a wide range of the Fe content and is still high at the upper limit thereof, depending upon the kind of additional element, so that the energy product is considerably increased without adverse effects on the magnetic properties of the permanent magnet.

When Zr is added to the ternary alloy of R-Co-Cu, cobalt can be replaced with up to 20% by weight of iron. When at least, two of the elements Nb, V, Ta and Zr are added to the RCo type alloy with the addition of Cu, cobalt can be replaced with up to 23% by weight of iron based on the weight of the permanent magnet.

The present invention is further illustrated with regard to the chemical compositions of the permanent magnet according to several embodiments thereof.

The rare earth metals according to the present invention can include, in addition to Sm, such elements having equivalent chemical properties to Sm as, Y, La, Ce, Pr, Nd, Eu, Gd, Tb, Dy, Ho, Er, Tm, Yb, Lu, but should exclude radioactive elements.

According to one embodiment of the present invention, a permanent magnet essentially consists of from 24 to 28%, preferably 25 to 27%, of at least one rare earth metal from, 56 to 70.8%, preferably 61.5 to 67.5%, of cobalt, from 5 to 12%, preferably 7 to 9%, of copper, and from 0.2 to 4%, preferably 0.5 to 2.5%, of niobium, all percentages being by weight. When the Nb content exceeds 4% by weight the coercive force is reduced and when the Nb content is below 0.2% the energy product is reduced. Within the range from 0.2 to 4% by weight of Nb, it is possible to provide a permanent magnet with an energy product of more than 17 MG.Oe and a coercive force more than 30 KOe.

According to a modification of said one embodiment, the cobalt can be replaced with up to 15%, preferably 8 to 15%, more preferably 10 to 14%, by weight of iron based on the weight of the permanent magnet. The energy product can be enhanced to approximately more than 24 MG.Oe or 26 MG.Oe.

According to another embodiment of the present invention, a permanent magnet essentially consists of from 24 to 28%, preferably from 25 to 27%, of at least one rare earth metal, from 56 to 70.8%, preferably 61.5 to 67.5%, of cobalt, from 5 to 12%, preferably 7 to 9%, of copper and from 0.2 to 4%, preferably 0.5 to 2.5%, of vanadium or tantalum, all percentages being by weight. The copper content can be from 5 to less than 7% by weight. When the V or Ta content exceeds 4% by weight the coercive force is reduced, and the V or Ta content below 0.2% leads to the reduction of the energy product.

According to a modification of this embodiment with the addition of V or Ta, the cobalt can be replaced with up to 15%, preferably 8 to 14%, more preferably 10 to 13%, by weight of iron based on the weight of the permanent magnet. The energy product can be enhanced to approximately more than 24 MG.Oe or 26 MG.Oe.

According to still another embodiment of the present invention, a permanent magnet essentially consists of from 24 to 28%, preferably from 25 to 27%, of at least one rare earth metal, from 55 to 70.8%, preferably from 61.5 to 67.5%, of cobalt, from 5 to 12%, preferably 7 to 9%, of copper and from 0.2 to 5%, preferably 0.5 to 2.5%, of zirconium, all percentages being by weight. When the Zr content does not fall within the range of from 0.2 to 5% by weight, both the coercive force and energy product are too low.

According to a modification of said embodiment with the Zr addition, the cobalt can be replaced with up to 15%, preferably 10 to 15%, more preferably 13 to 15%, by weight of iron based on the weight of the permanent magnet. The energy product can be enhanced to approximately more than 26 MG.Oe or 28 MG.Oe.

In all the permanent magnets according to the present invention, when the content of rare earth metal or metals exceeds 28% by weight, the residual magnetization is reduced, and its content below 24% leads to the reduction of the coercive force.

The permanent magnet according to the present invention can be produced by melting the required ingredients, solidifying the obtained molten metal in a mold, and crushing and pulverizing the obtained ingot, so as to subject the obtained powder to sintering. The ingredients can be pure Nb, Zr, V, Ta etc. or their alloys with Fe. The pulverizing is performed to produce powders having an average grain size of from 3 to 5 microns, by using a vibrating mill or, preferably, a jet mill. The employment of a jet mill enables the coercive force and the energy product to be increased. In the alloy compositions of the present invention, the coercive force and the energy product are increased by approximately 0.5 to 1 KOe and 1 to 2 MG.Oe, respectively. The best magnetic properties of the R-Co-Cu-Fe-Zr alloys produced by the steps including the pulverizing by the jet mill, the hereinbelow illustrated solution treatment and step tempering are 11.1 KG of the residual magnetization, 6.7 KOe of coercive force and 30 MG.Oe of energy product.

The powder is then pressed at a pressure, typically 1.5 ton/cm$^2$, in a magnetic field, typically 10 KOe, to produce green compact bodies. The green compact bodies are sintered at a temperature of from 1160° to 1230° C. The sintered bodies are cooled and, then, solution treated at a temperature from 1160° to 1250° C. over a period of from 0.5 to 3 hours, typically one hour, under a vacuum- or inert-atmosphere. When the replacing amount of Fe is zero or low, the sintered bodies can be directly subjected to the following tempering.

The solution treatment is followed by rapid cooling. Subsequently, the sintered article is tempered at a temperature of from 400° to 900° C., over a period of 0.3 to 24 hours. The preferable tempering process is a step tempering, wherein the tempering temperature is stepwise lowered from a beginning temperature of 750° to 900° C. down to a final temperature of 400° C. The more the number of steps, i.e. a temperature at which the sintered article is maintained for a certain period time, the better will be several of the magnetic properties of the sintered article. The number of steps should preferably be not less than two. When this number is increased to an infinite value, the tempering is performed by continuously cooling the sintered body from the beginning to final temperature. The tempering time at each step should preferably be not less than 24 hours. The step tempering increases the coercive force, for example as much as twice the ordinary tempering at a particular temperature.

The processes according to the invention provide, the advantages of enhancing the recovery of the produced alloys having stable magnetic properties, in addition to enhancing the magnetic properties of the alloys.

The invention will be understood more readily by reference to the following Examples; however these Examples are intended to illustrate the invention and are not to be construed as limiting the scope of the invention.

EXAMPLE 1

The required ingredients for the alloy compositions No. 1 and No. 2 as illustrated hereinbelow in Table 1 were dosed and the alloy mixtures were melted in an induction furnace under an argon atmosphere. The melt was cast into an iron pan to produce ingots. The ingots were roughly crushed in an iron mortar and finely crushed to powders having an average particle size of approximately 5 microns by using the vibrating mill. The powders were pressed and shaped under a magnetic field of 10 KOe and the so produced green compact bodies were sintered at a temperature of from 1230° to 1250° C. over a period of one hour. The cooled, sintered bodies were heated in a temperature range from 800° to 900° C. over a period of one hour and, subsequently, at a temperature of 500° C. over a period of five hours.

The permanent magnets, which were produced by the above-mentioned procedure, were subjected to measurement of magnetic properties, i.e. the residual magnetization, coercive force and energy product designated in the following Tables as Br, iHc and (B.H)max, respectively.

Table 1

| Specimen | Composition of Alloys (wt. %) | | | | | Br | iHc | (B.H)max |
|---|---|---|---|---|---|---|---|---|
| No. | Sm | Co | Cu | Fe | Nb | (KG) | (KOe) | (MG.Oe) |
| 1. (control) | 26.5 | 60.5 | 8.0 | 5.0 | 0 | 9.2 | 3.0 | 12.0 |
| 2. (invention) | 26.5 | 59.5 | 8.0 | 5.0 | 1.0 | 9.1 | 5.7 | 20.0 |

The Cu contents of the specimens Nos. 1 and 2 were determined to be 8.0% lower than that Cu content which has hitherto been believed to decrease the iHc. The Nb addition into the specimen No. 1 with low Cu content, considerably increased the iHc to 5.7 KOe, so that the remarkably increased energy product (B.H)max of 20 MG.Oe could be provided despite the low Cu content.

EXAMPLE 2

Specimens Nos. 3 and 4, having the compositions shown in Table 2, were produced in accordance with the procedure described in Example 1.

Table 2

| Specimen No. | Composition of Alloys (wt. %) | | | | |
|---|---|---|---|---|---|
| | Sm | Co | Cu | Fe | Nb |
| 3. (invention) | 26.5 | balance | 8.0 | 0–16 | 1.0 |
| 4. (control) | 26.5 | balance | 8.0 | 0–10 | 0 |

The Fe contents of these specimens were changed in the ranges shown in Table 2.

Figure 1:
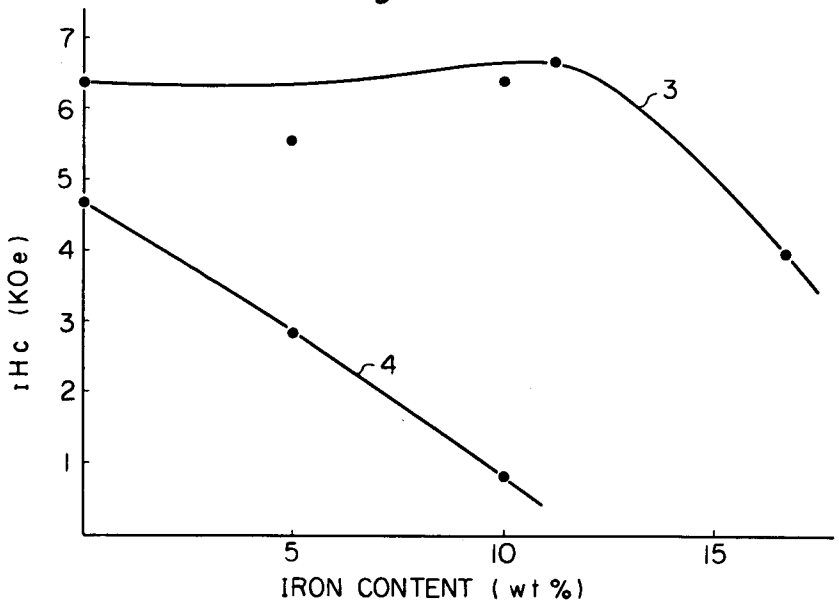
FIGS. 1, 3, 4, 6, 7 and 9 describe iron content function.

The influence of the Fe contents on the coercive force is illustrated in FIG. 1, in which reference numerals 3 and 4 represent the specimens 3 and 4, respectively, and the abscissa and ordinate represent the iron content and coercive force, respectively. As is clear from FIG. 1, specimen No. 3 containing Nb exhibits a high iHc up to 15% by weight of Fe, although in the specimen No. 4 without Nb the iHc decreases with the increase in the Fe content.

EXAMPLE 3

The specimens Nos. 5 and 6 illustrated in Table 3 were produced in accordance with the procedure described in Example 1.

Table 3

| Specimen | Composition of Alloys (wt. %) | | | | | Br | iHc | (B.H) max |
|---|---|---|---|---|---|---|---|---|
| No. | Sm | Co | Cu | Fe | Nb | (KG) | (KOe) | (MG.Oe) |
| 5. (control) | 26.5 | 56.5 | 12.0 | 5.0 | 0 | 9.0 | 6.0 | 19.5 |
| 6. (invention) | 26.5 | 55.5 | 12.0 | 5.0 | 1.0 | 8.8 | 6.6 | 19.0 |

The Cu contents of the specimens Nos. 5 and 6 were determined to be 12.0%, which content has hitherto been believed by metallurgists to be necessary for excellent magnetic properties of a rare earth cobalt permanent magnet. As seen in the Table 3, the iHc of specimen No. 6 is superior to that of specimen No. 5, which exhibits high iHc due to the high content of Cu.

EXAMPLE 4

The specimen No. 7, having the composition shown in Table 4, was produced in accordance with the procedure described in Example 1.

Table 4

| Specimen | Chemical Composition of Alloy (wt.%) | | | | |
|---|---|---|---|---|---|
| No. | Sm | Cu | Fe | Nb | Co |
| 7 | 26.5 | 8 | 10 | 0–4 | bal |

The Nb content of this specimen was changed in the range shown in Table 4.

Figure 2:
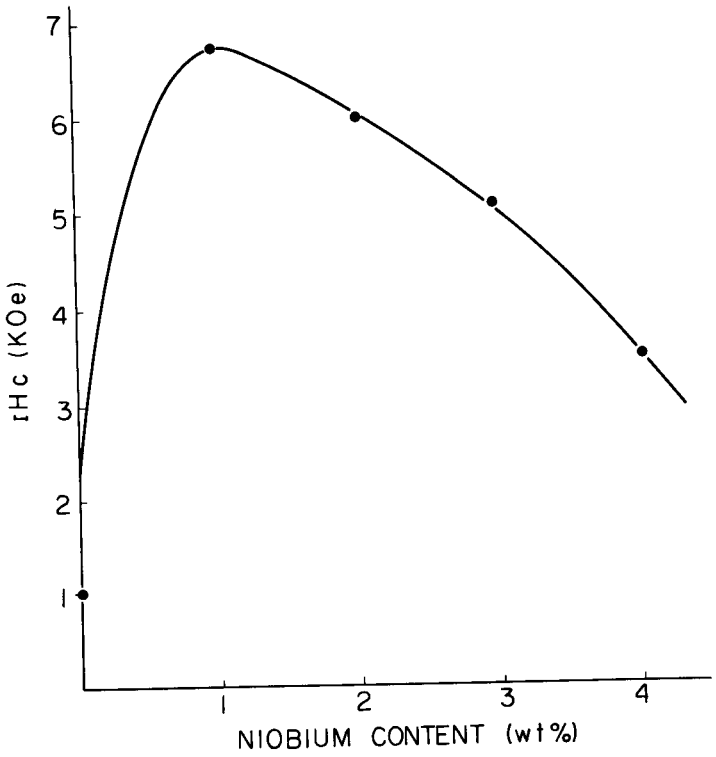
FIG. 2 describes niobium content function.

The influence of the Nb content on the coercive force is illustrated in FIG. 2. As seen in FIG. 2, the iHc is improved by the Nb addition from 0.4 to 4% by weight, preferably from 0.5 to 2.5% by weight, the most preferably being approximately 1% by weight. On the other hand the addition more than 4% of Nb reduces the iHc.

EXAMPLE 5

Specimens Nos. 8, 9 and 10, having the compositions shown in Table 5, were produced using the same procedure as described in Example 1 except that the sintering and heat treatment conditions illustrated hereinbelow were used.

Table 5

| Specimen | Composition of Alloys (wt.%) | | | | |
|---|---|---|---|---|---|
| No. | Sm | Cu | Fe | Nb | Co |
| 8. (invention) | 26.0 | 8.0 | 0–16 | 1.0 | bal |
| 9. (control) | 26.0 | 8.0 | 0–10 | 0 | bal |
| 10. (control) | 26.0 | 11 | 0–10 | 0 | bal |

The green compacts of the specimens Nos. 8 through 10 were sintered at temperature from 1180° to 1250° C., in a vacuum or inert atmosphere, and subsequently, after cooling to room temperature, were solution treated at a temperature from 1170° to 1230° C., followed by cooling to room temperature. The tempering was performed by a step tempering from 800° to 400° C. The temperature was decreased stepwise at each 100° C.

Figure 3:
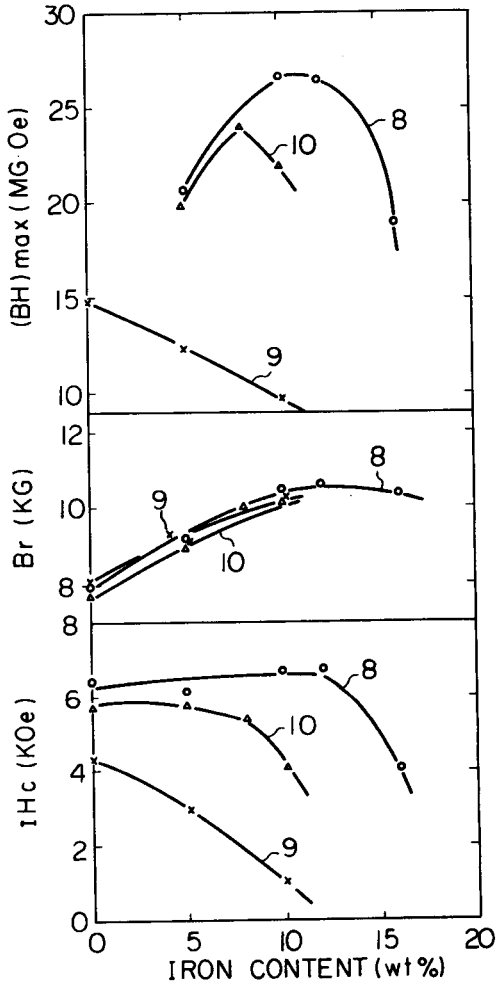

The influence of the Fe contents, shown in the abscissa, on the magnetic properties i.e. iHc, Br and (B.H)max, shown in the ordinate, is illustrated in FIG. 3, in which the reference numerals 8 through 10 indicate the specimens No. 8 through 10, respectively. It is possible to conclude the following from FIG. 3. (1) Specimen No. 8 containing both Nb according to the present invention and conventional Cu in a low amount, which is desirable for providing the rare earth cobalt alloy with a high Br, increases its iHc with the increase in the Fe content. (2) The (B.H)max of specimen No. 8 containing Nb, is higher than that of specimens Nos. 9 and 10, when the Fe content is adequately determined, for example from 8 to 15%, preferably from 10 to 14%.

EXAMPLE 6

Specimens Nos. 11 through 13, having the compositions shown in Table 6, were produced in accordance with the procedure described in Example 1.

Table 6

| Specimen No. | Composition of Alloys (wt. %) Sm | Co | Cu | Fe | V | Ta | Br (KG) | iHc (KOe) | (B.H) max (MG Oe) |
|---|---|---|---|---|---|---|---|---|---|
| 11. (control) | 26.5 | 60.5 | 8.0 | 5.0 | 0 | 0 | 9.2 | 3.0 | 12.0 |
| 12. (invention) | 26.5 | 59.5 | 8.0 | 5.0 | 1.0 | 0 | 9.1 | 6.2 | 20.3 |
| 13. (invention) | 26.5 | 59.5 | 8.0 | 5.0 | 0 | 1.0 | 9.1 | 5.6 | 20.0 |

The Cu contents of the specimens Nos. 11 through 13 were determined to be 8%, which has hitherto been believed by metallurgists to be too low to provide the Sm-Co-Cu-Fe quaternary system alloy with desirable coercive force. As is clear from Table 6, the addition of V or Ta considerably improves the iHc of the quaternary system alloy, with the result that the (B.H)max is remarkably enhanced.

EXAMPLE 7

Specimens Nos. 14 through 16 having the compositions as shown in Table 7, were produced in accordance with the procedure described in Example 1.

Table 7

| Specimen No. | Composition of Alloys (wt. %) Sm | Cu | Fe | V | Ta | Co |
|---|---|---|---|---|---|---|
| 14. (invention) | 26.5 | 8.0 | 0–18 | 1.0 | 0 | bal |
| 15. (invention) | 26.5 | 8.0 | 0–18 | 0 | 1.0 | bal |
| 16. (control) | 26.5 | 8.0 | 0–10.0 | 0 | 0 | bal |

The Fe contents were changed with in the ranges shown in Table 7.

Figure 4:
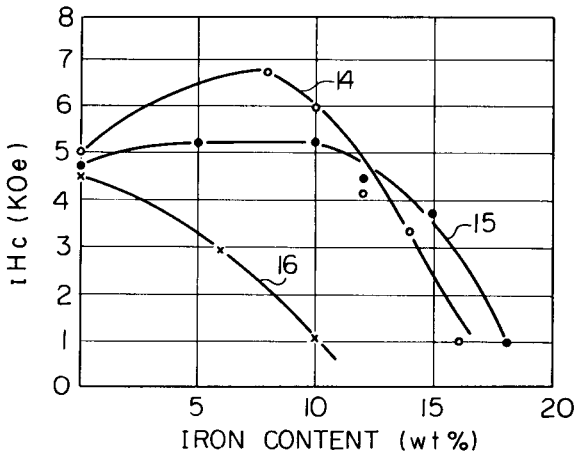

The influence of the Fe contents upon the coercive force is illustrated in FIG. 4, in which the reference numerals 14 through 16 indicate specimens Nos. 14 through 16, respectively.

It is possible to conclude from FIG. 4 as follows. (1) Specimens Nos. 14 and 15, containing one of V or Ta, exhibit increased iHc compared with the control specimen No. 16. (2) A high iHc can be obtained in the specimens Nos. 14 and 15 with up to 15% by weight of Fe. (3) A preferable Fe content for iHc is from 8 to 14% by weight.

EXAMPLE 8

Specimens Nos. 17 through 19, having the compositions as shown in Table 8, were produced in accordance with the procedure described in Example 1.

Table 8

| Specimen No. | Composition of Alloys (wt. %) Sm | Co | Cu | Fe | V | Ta | Br (KG) | iHc (KOe) | (B.H)max (MG.Oe) |
|---|---|---|---|---|---|---|---|---|---|
| 17. (control) | 26.5 | 56.5 | 12.0 | 5.0 | 0 | 0 | 9.0 | 6.0 | 19.5 |
| 18. (invention) | 26.5 | 55.5 | 12.0 | 5.0 | 1.0 | 0 | 8.9 | 6.7 | 19.5 |
| 19. (invention) | 26.5 | 55.5 | 12.0 | 5.0 | 0 | 1.0 | 8.8 | 6.5 | 19.0 |

The Cu contents of 12% by weight in specimens 17 through 19 has been believed by metallurgists to be necessary for excellent magnetic properties of a rare earth cobalt permanent magnet. However, as seen in Table 8, the addition of V or Ta improves iHc.

EXAMPLE 9

Specimen Nos. 20 and 21, having the compositions shown in Table 9, were produced in accordance with the procedure described in Example 1. The V or Ta contents were varied within the ranges shown in Table 9.

Table 9

| Specimen No. | Composition of Alloys (wt. %) Sm | Co | Cu | Fe | V | Ta |
|---|---|---|---|---|---|---|
| 20. (invention) | 26.5 | bal | 8.0 | 10.0 | 0–5 | 0 |
| 29. (control) | 26.5 | bal | 8.0 | 10.0 | 0 | 0–5 |

Figure 5:
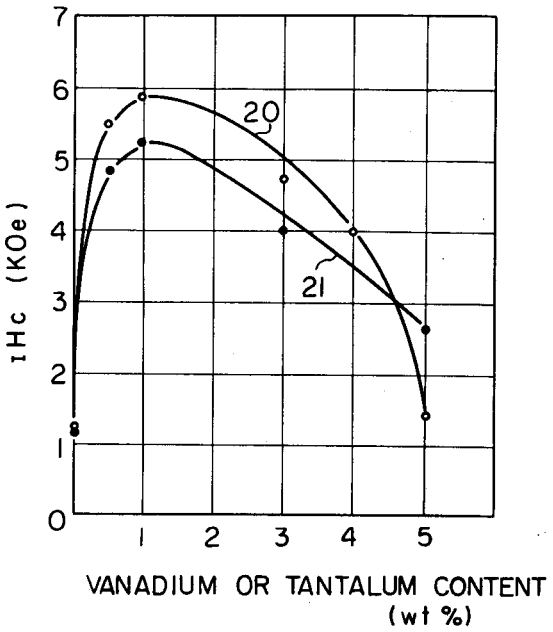
FIG. 5 describes tantalum content function.

The influence of the V or Ta contents on the coercive force is illustrated in FIG. 5, in which the reference numerals 20 and 21 indicate specimens 20 and 21, respectively. As is clear from FIG. 5, the iHc arrives at the maximum value at approximately 1% by weight of V or Ta. The iHc is too low when the V or Ta contlent exceed 4% by weight. The iHc is extremely high at a V or Ta content of from 0.5 to 2.5% by weight.

EXAMPLE 10

Specimens Nos. 22, 23 and 24, having the compositions shown in Table 10, were produced using the same procedure as described in Example 1, except for the sintering and heat treatment conditions as illustrated hereinbelow.

Table 10

| Specimen No. | Composition of Alloys (wt. %) Sm | Co | Cu | Fe | V | Ta |
|---|---|---|---|---|---|---|
| 22 | 26 | bal | 8 | 0–18 | 1 | 0 |
| 23 | 26 | bal | 8 | 0–18 | 0 | 1 |
| 24 | 26 | bal | 8 | 0–10 | 0 | 0 |

The green compacts of the specimens Nos. 22, 23 and 24 were sintered at temperature of from 1160° to 1250° C., in a vacuum or inert atmosphere, and subsequently, after cooling to room temperature, were solution treated at temperature of from 1140° to 1230° C., followed by cooling to room temperature. The tempering was performed by a step tempering of from 800° to 400° C. as in Example 5.

The influence of the Fe contents, shown in the abscissa, on the magnetic properties, i.e. iHc, Br and (B.H)max, shown in the ordinate, is illustrated in FIG.

Figure 6:
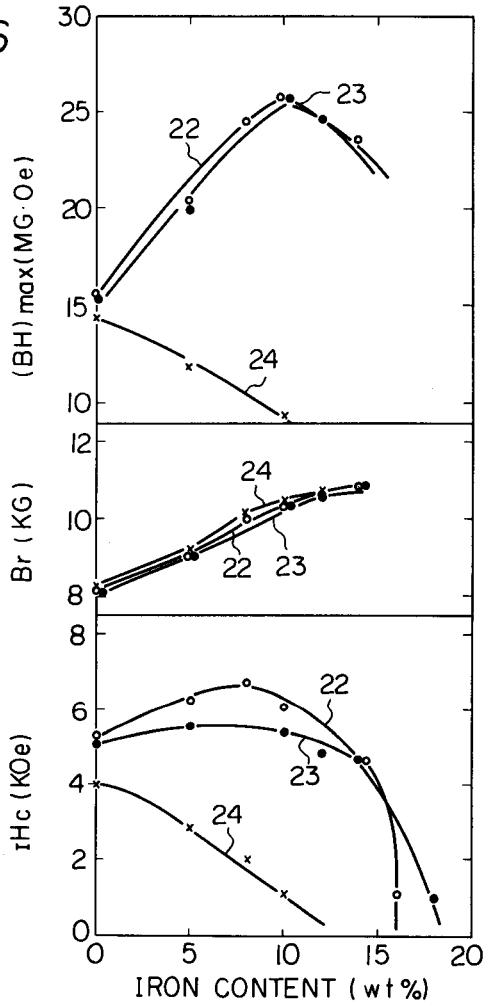

6, in which the reference numerals 22 through 24 indicate specimens Nos. 22 through 24, respectively. It is possible to conclude the following from FIG. 6. (1) Specimens Nos. 22 and 23, containing V and Ta, respectively, according to the present invention, and conventional Cu in a low amount, which is desirable for providing the Sm-Co-Fe-Cu quaternary alloy with a high Br, maintain high iHc with the increase in the Fe content. (2) A high iHc can be obtained in the specimens Nos. 22 and 23 with up to 15% by weight of Fe. (3) A preferable Fe content for (B.H)max is from 8 to 14% and 10 to 13%, by weight.

EXAMPLE 11

Specimens Nos. 25 and 26, having the compositions shown in Table 11, were produced in accordance with the procedure described in Example 1.

Table 11

| Specimen No. | Composition of Alloys (wt. %) Sm | Co | Cu | Fe | Zr | Br (KG) | iHc (KOe) | (B.H)-max (MG . Oe) |
|---|---|---|---|---|---|---|---|---|
| 25. (control) | 26.5 | 60.5 | 8.0 | 5.0 | 0 | 9.2 | 3.0 | 12.0 |
| 26. (invention) | 26.5 | 59.5 | 8.0 | 5.0 | 1.0 | 9.1 | 6.5 | 20.5 |

As is clear from Table 11, the addition of Zr considerably improves the iHc of the quaternary system alloy, with the result that the (B.H)max is remarkably enhanced.

EXAMPLE 12

Specimens Nos. 27 and 28, having the compositions as shown in Table 12, were produced in accordance with the procedure described in Example 1.

Table 12

| Specimen No. | Composition of Alloys (wt. %) Sm | Co | Cu | Fe | Zr |
|---|---|---|---|---|---|
| 27. (invention) | 26.5 | bal | 8.0 | 0-16 | 1.0 |
| 28. (control) | 26.5 | bal | 8.0 | 0-10.0 | 0 |

The Fe contents were changed with in the ranges shown in Table 12.

Figure 7:
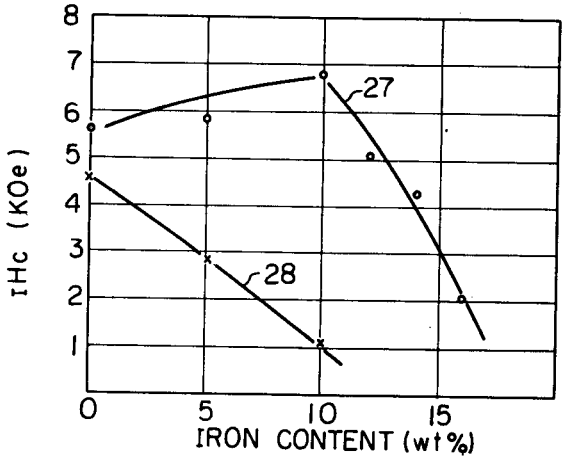

The influence of the Fe contents upon the coercive force is illustrated in FIG. 7, in which the reference numerals 27 and 28 indicate the specimens Nos. 27 and 28, respectively.

It is possible to conclude the following from FIG. 7. (1) Specimen No. 27, containing Zr exhibits increase iHc compared with the control specimen No. 28. (2) A high iHc can be obtained in specimen No. 27 with up to 15% by weight of Fe.

EXAMPLE 13

Specimens Nos. 29 and 30, having the compositions shown in Table 13, were produced in accordance with the procedure described in Example 1.

Table 13

| Specimen No. | Composition of Alloys (wt. %) Sm | Co | Cu | Fe | Zr | Br (KG) | iHc (KOe) | (B.H)-max (MG . Oe) |
|---|---|---|---|---|---|---|---|---|
| 29. (control) | 26.5 | 56.5 | 12.0 | 5.0 | 0 | 9.0 | 6.0 | 19.5 |
| 30. (invention) | 26.5 | 55.5 | 12.0 | 5.0 | 1.0 | 8.9 | 6.7 | 19.7 |

Table 13-continued

| Specimen No. | Composition of Alloys (wt. %) Sm | Co | Cu | Fe | Zr | Br (KG) | iHc (KOe) | (B.H)-max (MG . Oe) |
|---|---|---|---|---|---|---|---|---|

The Cu contents of 12% by weight in specimens 29 and 30 has been believed by metallurgists to be necessary to provide the quaternary system alloy with a high iHc. As seen in Table 13, the addition of Zr also improves iHc at the high Cu content.

EXAMPLE 14

Specimen No. 31, having the composition shown in Table 14, was produced in accordance with the procedure described in Example 1. The Zr content was varied within the ranges shown in Table 14.

Table 14

| Specimen No. | Composition of Alloys (wt. %) Sm | Co | Cu | Fe | Zr |
|---|---|---|---|---|---|
| 31 | 26.5 | bal | 8.0 | 10.0 | 0-6 |

Figure 8:
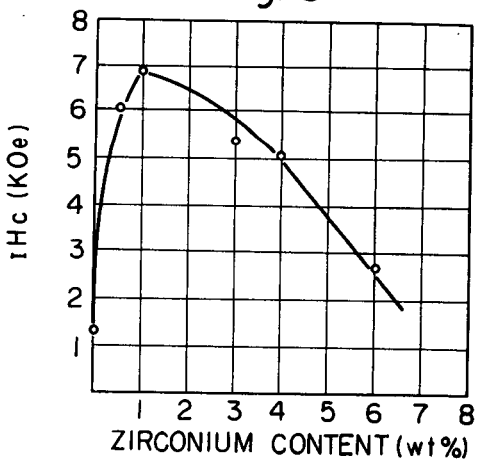
FIG. 8 describes zirconium content function.

The influence of the Zr content on the coercive force is illustrated in FIG. 8. As is clear from FIG. 8, the iHc arrives at the maximum value at approximately 1% by weight of Zr. The iHc is too low when the Zr content exceeds 5% by weight. The iHc is extremely high at the Zr content of from 0.5 to 2.5% by weight.

EXAMPLE 15

Specimens Nos. 32 through 34, having the compositions as shown in Table 15, were produced in accordance with the procedure described in Example 1, except for the sintering and heat treatment conditions.

Table 15

| Specimen No. | Composition of Alloys (wt. %) Sm | Co | Cu | Fe | Zr |
|---|---|---|---|---|---|
| 32. (invention) | 25.5 | bal | 8.0 | 0-16 | 1.1 |
| 33. (control) | 25.5 | bal | 8.0 | 0-10 | 0 |
| 34. (control) | 26.5 | bal | 11.0 | 0-10 | 0 |

The Fe content was changed within the ranges shown in Table 15. The Cu content of specimen 34 was such that the highest (B.H)max was obtained without the addition of Zr.

The green compacts of specimens Nos. 32 through 34 were sintered at temperature of from 1170° to 1250° C., over a period of approximately one to two hours, and subsequently, after cooling to room temperature, were solution treated at temperature of from 1170° to 1230° C., followed by cooling to room temperature. The tempering was performed by a step tempering of from 850° to 400° C.

Figure 9:
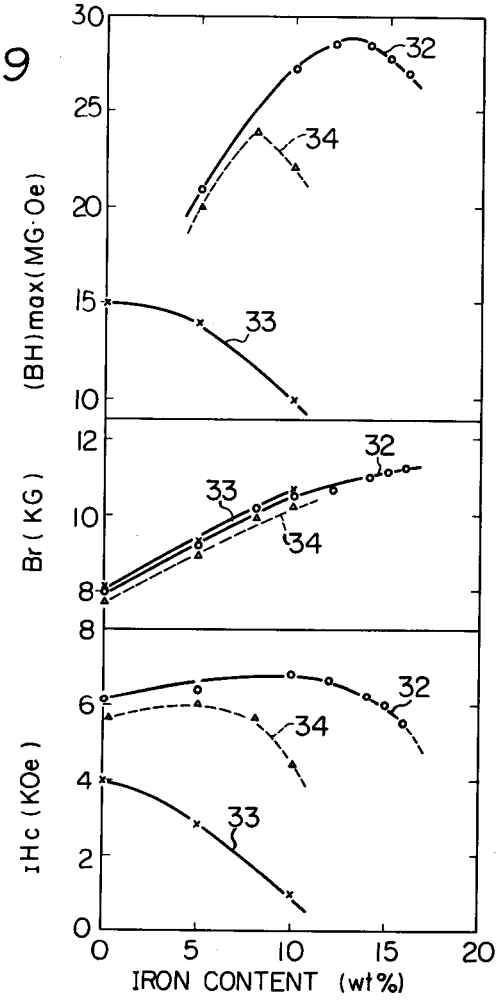

The influence of the Fe content on the magnetic properties i.e. iHc, Br and (B.H)max, is illustrated in FIG. 9, in which the reference numerals 32 through 34 indicate specimens No. 32 through 34, respectively. It is possible to the following conclude from FIG. 9. (1) Specimen No. 32 containing Zr according to the present invention and conventional Cu in a low amount, which is desirable for providing the Sm-Co-Fe-Cu, quaternary alloy with the high Br, maintains high iHc with the increase in the Fe content. (2) The (B H)max of the specimen No. 32 is higher than that of No. 33 and even higher than that of No. 34, when the Fe content of specimen No. 32 is adequately determined, for example up to 15%, preferably from 10 to 15%, more preferably 13 to 15% by weight.

EXAMPLE 16

Specimen 31 of Example 14 was produced by the same process as described in Example 14, except that the crushing was performed by the jet mill. The obtained maximum values were: Br=11.1 KG; iHc=6.7 KOe, and; (B.H)max=30 MG.Oe.

What is claimed is:

1. A permanent magnet of $R_2Co_{17}$ type crystal structure consisting essentially of at least one rare earth metal in an amount of from 24 to 28% by weight, copper in an amount of from 5 to 12% by weight, iron in an amount of from 8 to 15% by weight, a total combined amount of cobalt and iron being from 56 to 70.8% by weight, and niobium in an amount of from 0.2 to 4% by weight, all percentages being based on the total weight of magnet.

2. A permanent magnet according to claim 1, wherein said amount of said iron is from 10 to 14% by weight.

3. A permanent magnet according to claim 1, wherein said amount of said R is from 25 to 27% by weight, said combined amount of said cobalt and iron is from 61.5 to 67.5% by weight, said amount of said copper is from 7 to b 9% by weight and said amount of said niobium is from 0.5 to 2.5% by weight.

4. A permanent magnet according to claim 1, wherein said magnet has an energy product in excess of 17 MG.Oe.

5. A permanent magnet according to claim 1, wherein said magnet has a coercive force in excess of 3 KOe.

6. A permanent magnet according to claim 1, wherein said magnet has an energy product of at least 20 MG.Oe.

7. A permanent magnet according to claim 1, wherein said magnet has a coercive force of at least 5.6 KOe.

8. A permanent magnet according to claim 1, wherein said magnet has an energy product in excess of 24 MG.Oe.

9. A permanent magnet of $R_2Co_{17}$ type crystal structure consisting essentially of at least one rare earth metal in an amount of from 24 to 28% by weight, copper in an amount of from 5 to 12% by weight, iron in an amount of from 8 to 14% by weight, a total combined amount of cobalt and iron being from 56 to 70.8% by weight, and tantalum in an amount of from 0.2 to 4% by weight, all percentages being based on the total weight of magnet.

10. A permanent magnet according to claim 9, wherein said amount of said iron is from 10 to 13% by weight.

11. A permanent magnet according to claim 9, wherein said amount of said R is from 25 to 27% by weight, said combined amount of said cobalt and iron is from 61.5 to 67.5% by weight, said amount of said copper is from 7 to 9% by weight and said amount of said tantalum is from 0.5 to 2.5% by weight.

12. A permanent magnet according to claim 9, wherein said magnet has an energy product in excess of 24 MG.Oe.

13. A permanent magnet according to claim 9, wherein said magnet has an energy product in excess of 17 MG.Oe.

14. A permanent magnet according to claim 9, wherein said magnet has a coercive force in excess of 3 KOe.

15. A permanent magnet according to claim 9, wherein said magnet has an energy product of at least 20 MG.Oe.

16. A permanent magnet according to claim 9, wherein said magnet has a coercive force of at least 5.6 KOe.

17. A permanent magnet of $R_2Co_{17}$ type crystal structure consisting essentially of at least one rare earth metal in an amount of from 24 to 28% by weight, copper in an amount of from 5 to 12% by weight, iron in an amount of from 10 to 15% by weight, a total combined amount of cobalt and iron being from 55 to 70.8% by weight, and zirconium in an amount of from 0.2 to 5% by weight, all percentages being based on the total weight of magnet.

18. A permanent magnet according to claim 17, wherein said amount of said iron is from 13 to 15% by weight.

19. A permanent magnet according to claim 17, wherein said amount of said R is from 25 to 27% by weight, said combined amount of said cobalt and iron is from 61.5 to 67.5% by weight, said amount of said copper is from 7 to 9% by weight and said amount of said zirconium is from 0.5 to 2.5% by weight.

20. A permanent magnet according to claim 17, wherein said magnet has an energy product in excess of 26 MG.Oe.

21. A permanent magnet according to claim 17, wherein said magnet has an energy product in excess of 17 MG.Oe.

22. A permanent magnet according to claim 17, wherein said magnet has a coercive force in excess of 30 KOe.

23. A permanent magnet according to claim 17, wherein said magnet has an energy product of at least 20 MG.Oe.

24. A permanent magnet according to claim 17, wherein said magnet has a coercive force of at least 5.6 KOe.

25. A process for producing a permanent magnet of $R_2Co_{17}$ type crystal structure having a composition consisting essentially of at least one rare earth metal in an amount of from 24 to 28% by weight, copper in an amount of from 5 to 12% by weight, iron in an amount of from 8 to 15% by weight, a total combined amount of cobalt and iron being 56 to 70.8% by weight, and niobium in an amount of from 0.2 to 4% by weight, all percentages being based on the total weight of said magnet, said process comprising the steps of sintering powders having said composition, and tempering the sintered bodies, wherein the tempering temperature is lowered stepwise from a temperature not greater than 900° C. to 400° C., the number of tempering steps being at least two.

26. A permanent magnet according to claim 25, wherein said magnet has an energy product in excess of 17 MG.Oe.

27. A permanent magnet according to claim 25, wherein said magnet has a coercive force in excess of 3 KOe.

28. A permanent magnet according to claim 25, wherein said magnet has an energy product of at least 20 MG.Oe.

29. A permanent magnet according to claim 25, wherein said magnet has a coercive force of at least 5.6 KOe.

30. A permanent magnet according to claim 25, wherein said magnet has an energy product in excess of 24 MG.Oe.

31. A process for producing a permanent magnet of $R_2CO_{17}$ type crystal structure having a composition consisting essentially of at least one rare earth metal in an amount of from 24 to 28% by weight, copper in an amount of from 5 to 12% by weight, iron in an amount of 8 to 14% by weight, a total combined amount of cobalt and iron being 56 to 70.8% by weight, and tantalum in an amount of from 0.2 to 4% by weight, all percentages being based on the total weight of said magnet, said process comprising the steps of sintering powders having said composition, and tempering the sintered bodies, wherein the tempering temperature is lowered stepwise from a temperature not greater than 900° C. to 400° C., the number of tempering steps being at least two.

32. A permanent magnet according to claim 31, wherein said magnet has an energy product in excess of 17 MG.Oe.

33. A permanent magnet according to claim 31, wherein said magnet has a coercive force in excess of 3 KOe.

34. A permanent magnet according to claim 31, wherein said magnet has an energy product of at least 20 MG.Oe.

35. A permanent magnet according to claim 31, wherein said magnet has a coercive force of at least 5.6 KOe.

36. A permanent magnet according to claim 31, wherein said magnet has an energy product in excess of 24 MG.Oe.

37. A process for producing a permanent magnet of $R_2CO_{17}$ type crystal structure having a composition consisting essentially of at least one rare earth metal in an amount of from 24 to 28% by weight, copper in an amount of from 5 to 12% by weight, iron in an amount of from 10 to 15% by weight, a total combined amount of cobalt and iron being 55 to 70.8% by weight, and zirconium in an amount of from 0.2 to 5% by weight, all percentages being based on the total weight of said magnet, said process comprising the steps of sintering powders having said composition, and tempering the sintered bodies, wherein the tempering temperature is lowered stepwise from a temperature not greater than 900° C. to 400° C., the number of tempering steps being at least two.

38. A permanent magnet according to claim 27, wherein said magnet has an energy product in excess of 17 MG.Oe.

39. A permanent magnet according to claim 37, wherein said magnet has a coercive force in excess of 3 KOe.

40. A permanent magnet according to claim 37, wherein said magnet has an energy product of at least 20 MG.Oe.

41. A permanent magnet according to claim 37, wherein said magnet has a coercive force of at least 5.6 KOe.

42. A permanent magnet according to claim 37, wherein said magnet has an energy product in excess of 26 MG.Oe.

* * * * *